US009015890B1

(12) United States Patent
Owens

(10) Patent No.: US 9,015,890 B1
(45) Date of Patent: Apr. 28, 2015

(54) BIODEGRADABLE TOILET SNAKE

(71) Applicant: David Owens, Green Acres, FL (US)

(72) Inventor: David Owens, Green Acres, FL (US)

( * ) Notice: Subject to any disclaimer, the term of this patent is extended or adjusted under 35 U.S.C. 154(b) by 0 days.

(21) Appl. No.: 14/552,661

(22) Filed: Nov. 25, 2014

(51) Int. Cl.

| | |
|---|---|
| ***B08B 9/02*** | (2006.01) |
| ***B08B 9/027*** | (2006.01) |
| ***E03C 1/30*** | (2006.01) |
| ***E03C 1/302*** | (2006.01) |

(52) U.S. Cl.
CPC ..... *E03C 1/302* (2013.01); *B08B 9/027* (2013.01)

(58) Field of Classification Search
CPC ..... B08B 9/02; B08B 9/027; E03C 1/30; E03C 1/302
See application file for complete search history.

(56) References Cited

U.S. PATENT DOCUMENTS

| | | | | |
|---|---|---|---|---|
| 5,230,116 | A | 7/1993 | Rodriguez | |
| 5,769,960 | A | 6/1998 | Nirmel | |
| 6,094,765 | A * | 8/2000 | Askenase | 15/104.05 |
| 6,775,873 | B2 | 8/2004 | Luoma | |
| 7,584,513 | B2 | 9/2009 | Turner | |
| 7,765,626 | B2 * | 8/2010 | Sapia | 4/255.11 |
| D657,099 | S | 4/2012 | Zach | |
| 8,359,696 | B1 | 1/2013 | Turner | |
| 8,510,891 | B2 | 8/2013 | Fivecoate | |

* cited by examiner

*Primary Examiner* — Randall Chin
(74) *Attorney, Agent, or Firm* — Kyle A. Fletcher, Esq.

(57) ABSTRACT

The biodegradable toilet snake is a tool for dislodging clogs in drainpipes. Once a drainpipe clog is dislodged, the snake is detached and left in the drainpipe where the snake dissolves in water.

15 Claims, 3 Drawing Sheets

BIODEGRADABLE TOILET SNAKE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of plumbing, more specifically, an accessory configured for use in clearing clogged drainpipes.

SUMMARY OF INVENTION

The biodegradable toilet snake is a tool for dislodging clogs in drainpipes. The snake is made of a blend of water-soluble materials that provide the strength and rigidity to physically dislodge the clog and will subsequently dissolve within approximately one hour. Once a drainpipe clog is dislodged, the snake is detached and left in the drainpipe where the snake dissolves in the water. The biodegradable toilet snake is comprised of a shaft and the snake.

These together with additional objects, features and advantages of the biodegradable toilet snake will be readily apparent to those of ordinary skill in the art upon reading the following detailed description of the presently preferred, but nonetheless illustrative, embodiments when taken in conjunction with the accompanying drawings.

In this respect, before explaining the current embodiments of the biodegradable toilet snake in detail, it is to be understood that the biodegradable toilet snake is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the biodegradable toilet snake.

It is therefore important that the claims be regarded as including such equivalent construction insofar as they do not depart from the spirit and scope of the biodegradable toilet snake. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
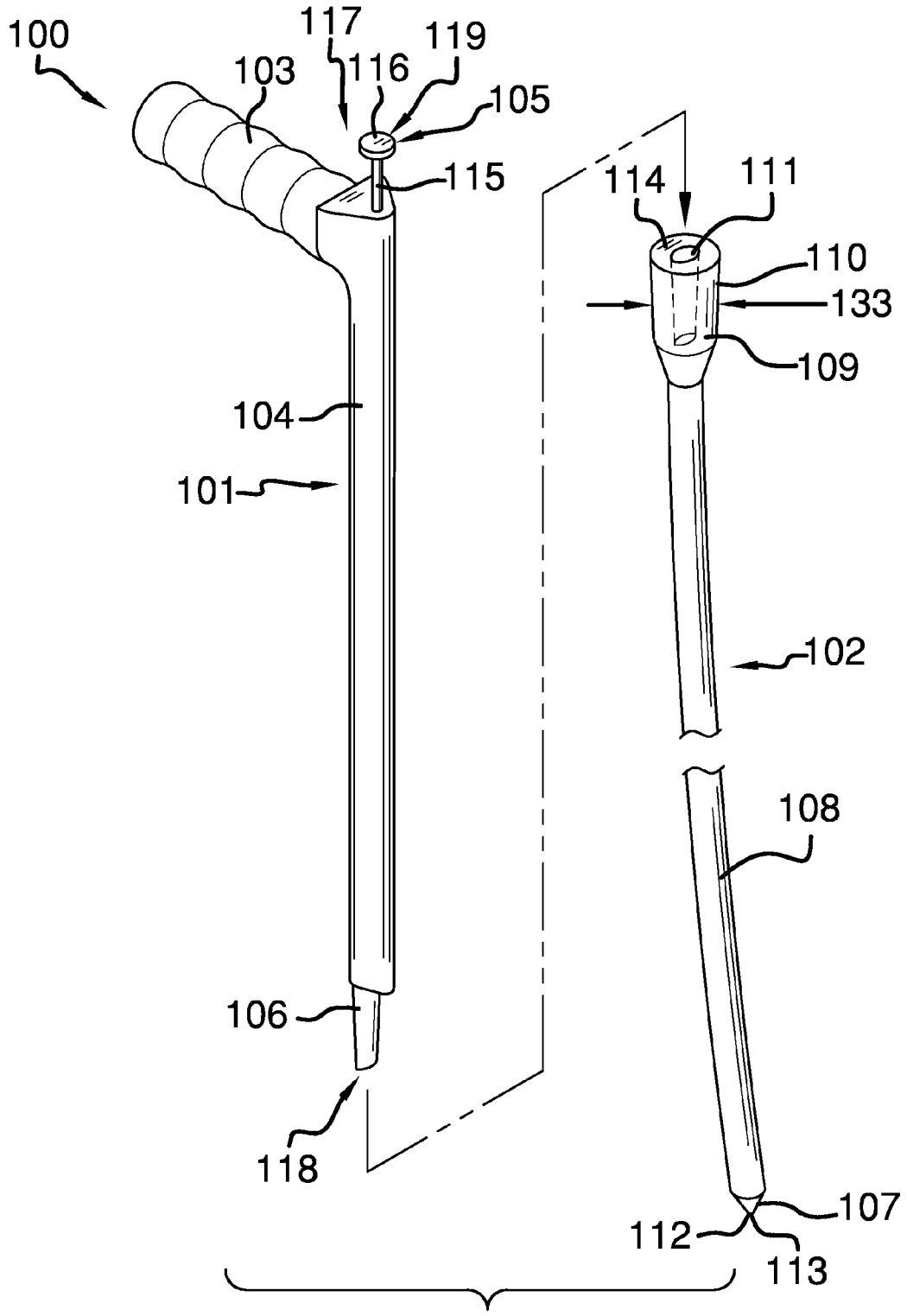
FIG. 1 is a projection view of an embodiment of the disclosure.
Figure 2:
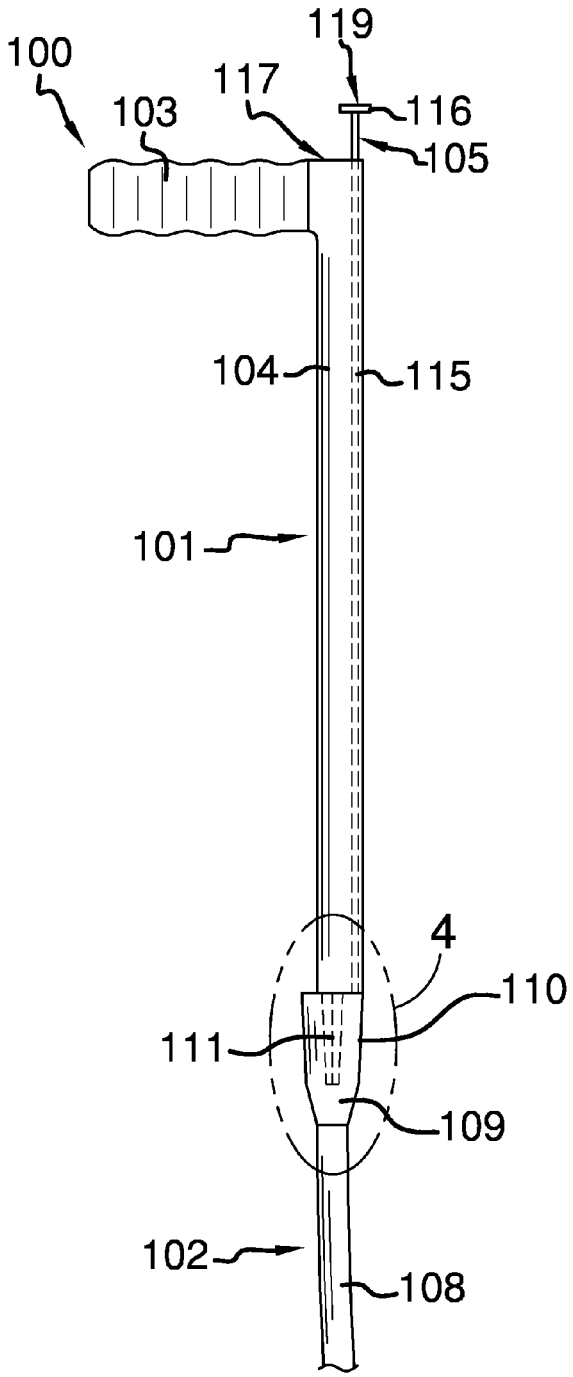
FIG. 2 is a side view of an embodiment of the disclosure.
Figure 3:
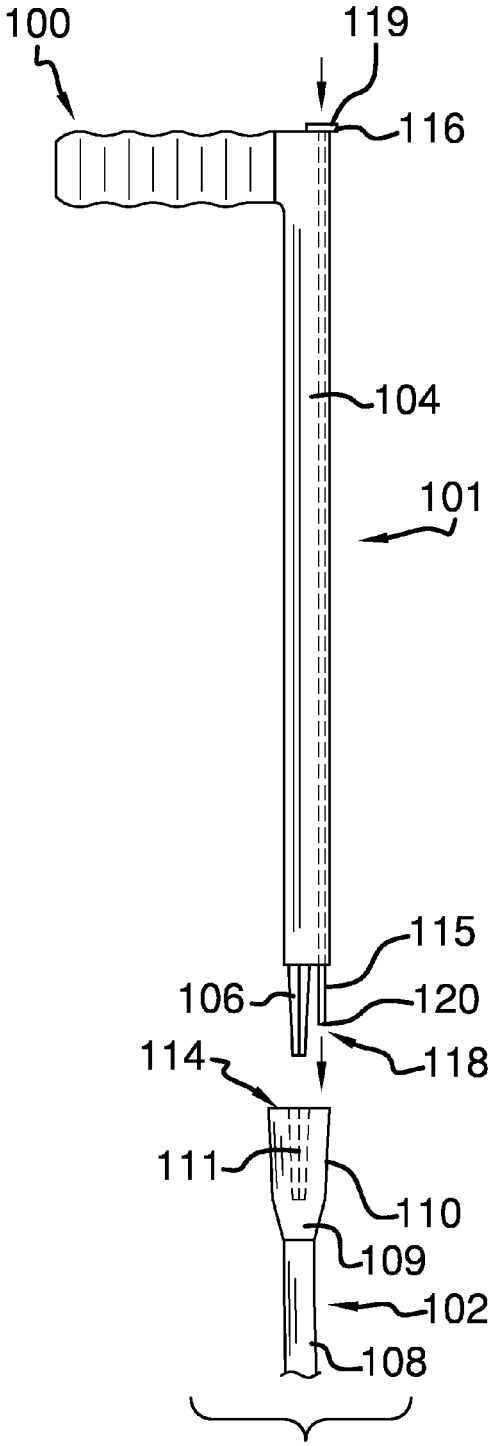
FIG. 3 is a side view of an embodiment of the disclosure.
Figure 5:
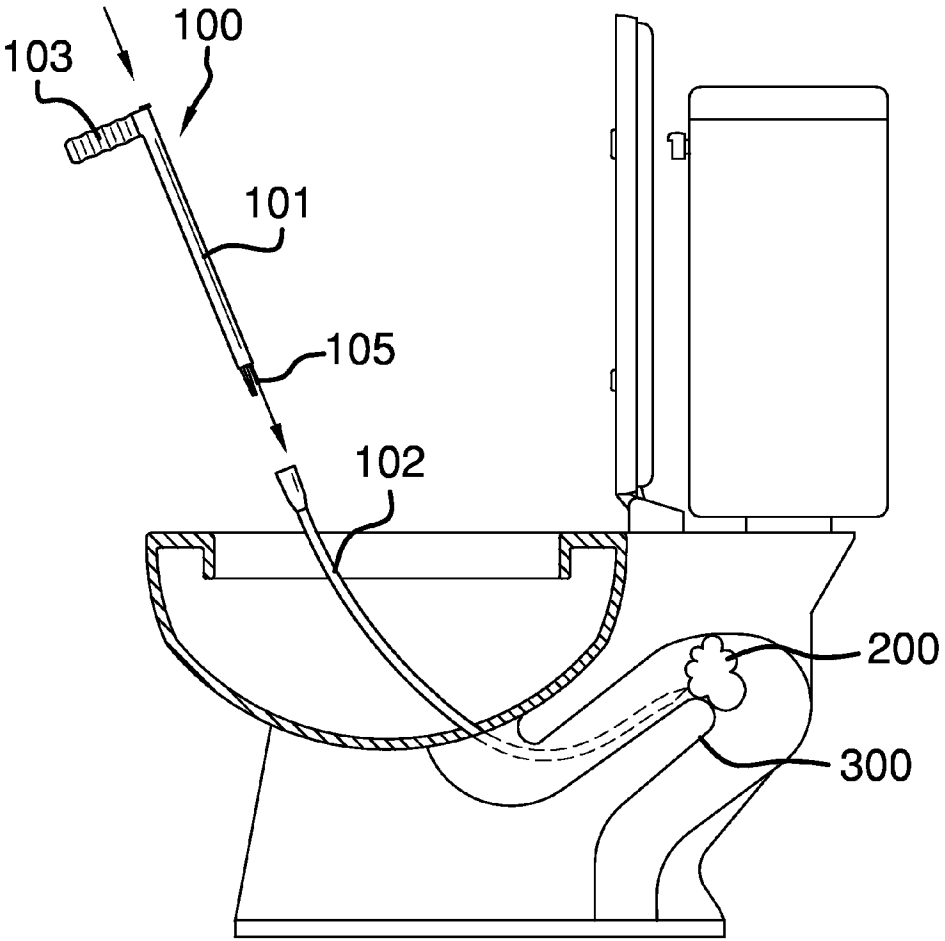
FIG. 5 is an in use view of an embodiment of the disclosure.
Figure 4:
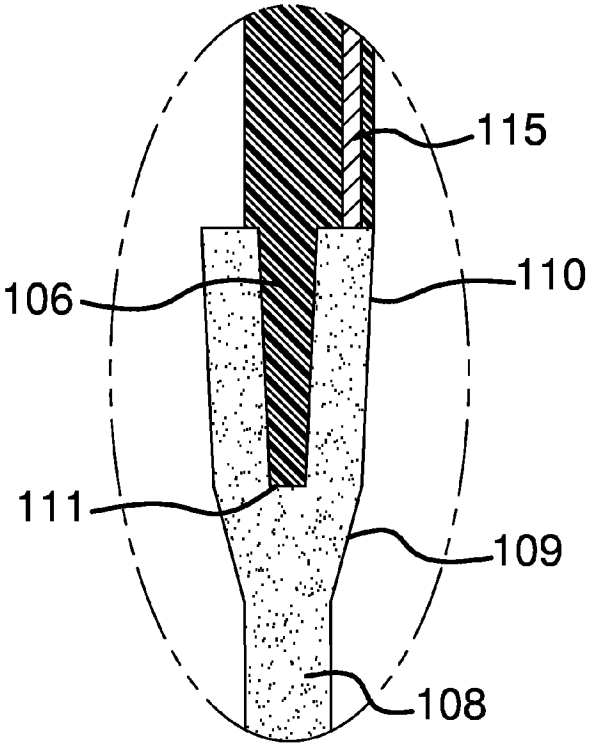
FIG. 4 is a detailed view of an embodiment of the disclosure in FIG. 2.

Detailed reference will now be made to a potential embodiment of the present invention 100, examples of which are illustrated in FIGS. 1 through 5. The biodegradable toilet snake 100 (hereinafter invention) comprises a shaft 101 and a snake 102.

The snake 102 is formed as a single unit and is made of water-soluble materials similar to the materials used to make urinal deodorizer blocks. The snake 102 is further defined with a point 107, a tube 108, a cone 109, a cylinder 110, and a wedge receptacle 111. The point 107 of the snake 102 is located on a first end 113. A second end 114 of the snake 102 is opposite of the first end 113.

The point 107 is tapered to form a tip 112 that can be sharp or rounded. The tip 112 is adaptively used to break up a lodged object 200 within a drainpipe 300. The tube 108 is a cylindrically shaped component of the snake 102 that connects the point 107 and the cone 109. The cone 109 is the section of the snake 102 that tapers out from the tube 108 to the cylinder 110. The purpose of the cone 109 is to increase an overall diameter 133 of the snake 102 so that it is compatible with the shaft 101. The cylinder 110 is located on the second end 114 of the snake 102, which is opposite of the first end 113 of the snake 102. The purpose of the cylinder 110 is to house a wedge receptacle 111, and provide a surface for the detach plunger 105 to push against when detaching the snake 102. The wedge receptacle 111 is a cavity formed into the cylinder 110 that is located on the second end 114 of the snake 102. The size and shape of the wedge receptacle 111 matches the size and shape of a male wedge 106. The wedge receptacle 111 acts as a female component that corresponds with and receives the male wedge 106 in order to secure the snake 102 to the shaft 101.

The snake 102 is formed as a single unit from a combination of water-soluble materials selected to provide the plasticity required to dislodge the lodged object 200 from the drainpipe 300. The combination of water-soluble material includes, but is not limited to, a combination of paraffinum liquidum, titanium dioxide, sodium dodecylbenzenesulfonate, sodium sulfate, hydrated silica, sodium olefin sulfonate (C14-C16), and aluminum hydroxide. As an option, colors and fragrances may also be added. Combinations of these chemicals are known in the soap making arts and are commonly used in block form in urinals as a deodorant.

The shaft 101 comprises a handle 103, a pole 104, the detach plunger 105 and the male wedge 106. The pole 104 is a hollow tube, and is the structure to which the handle 103, detach plunger 105, and male wedge 106 are attached. The pole 104 has a third end 117 and a fourth end 118. The male wedge 106 is mounted at the fourth end 118 of the pole 104. The pole may or may not have end caps. If end caps are provided, holes must be formed in the end cap to accommodate the detach plunger 105.

The detach plunger 105 is further defined with a rod 115, plunge cap 116 and a mounting mechanism. The rod 115 is shaped in the form of a rigid cylinder. The rod 115 has a fifth end 119 and a sixth end 120. The plunge cap 116 is a small disk that is mounted on the fifth end 119 of the rod 115. The purpose of the plunge cap 116 is to provide a convenient location to manually push in order to detach the snake 102. When the snake 102 is attached to the shaft 101, the sixth end 120 of the rod 115 sits against the snake 102. The rod 115 is mounted inside the pole 104 so that when the snake 102 is attached to the shaft 101 the sixth end 120 of the rod 115 sits against the snake 102. The rod 115 may be mounted within the pole 104 using standard hardware components such as eye screws.

The male wedge 106 is attached to the fourth end 118 of the pole 104. The male wedge 106 is a wedge shaped device that tapers to an edge. The wide edge of the male wedge 106 is attached to the pole 104. The wedge may be attached to the pole 104 using standard hardware components.

The handle 103 is a grip provided for convenience that is attached to the third end 117 of the pole 104. The handle 103 may be attached to the pole 104 using standard hardware components.

The pole 104 and handle 103 may be made of PVC piping. The rod 115 may be made of wooden dowel or a metal or plastic rod. The plunge cap 116 may be formed of plastic or metal. The male wedge 106 may be formed of plastic or metal. In an alternative embodiment, the pole 104, handle 103, male wedge 106 of the detach plunger 105 may be formed as a single unit from molded polyethylene. The rod 115 and plunge cap 116 of the detach plunger 105 may be formed separately as a single unit from molded polyethylene.

To use the invention 100, the snake 102 is attached to the shaft 101 by inserting the male wedge 106 into the wedge receptacle 111. Using the shaft 101 to control the invention 100, the snake 102 is inserted into the drainpipe and with the user pushes and pulls the invention 100 into and out of the drainpipe. This motion mechanically breaks up the material clogging the drainpipe and allows water to flow freely. After the material clogging the drain pipe is broken up, the snake 102 is detached by pressing down on the detach plunger 105 which pushes the snake 102 away from the shaft 101 and leaves the snake 102 in the drain pipe to dissolve.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A tool for dislodging a drainpipe comprising;
a shaft temporarily attached to a snake;
wherein said snake is adapted to dislodge a lodged object inside of a drainpipe;
wherein the snake is made of a water-soluble material so as to dissolve in water after use in dislodging of said lodged object;
wherein the snake is detachable from the shaft;
wherein the shaft is further defined as a pole, a detach plunger, and a male wedge.

2. The tool for dislodging a drainpipe according to claim 1 wherein the snake is further defined with a wedge receptacle.

3. The tool for dislodging a drainpipe according to claim 2 wherein the snake is temporarily attached to the shaft by inserting the male wedge into the wedge receptacle; wherein the snake is detached from the shaft using the detach plunger.

4. The tool for dislodging a drainpipe according to claim 3 wherein the snake is formed from material comprising paraffinum liquidum, titanium dioxide, sodium dodecylbenzenesulfonate, sodium sulfate, hydrated silica, sodium olefin sulfonate, and aluminum hydroxide.

5. The tool for dislodging a drainpipe according to claim 4 wherein the snake is further defined with a point, a tube, a cone, a cylinder, and the wedge receptacle.

6. The tool for dislodging a drainpipe according to claim 5 wherein the point of the snake is located on a first end; wherein a second end of the snake is opposite of the first end.

7. The tool for dislodging a drainpipe according to claim 6 wherein the point of the snake is tapered to form a tip that is sharp or rounded; wherein the tip is adaptively used to break up said lodged object within said drain pipe.

8. The tool for dislodging a drainpipe according to claim 7 wherein the tube is a cylindrically shaped component of the snake that connects the point and the cone; wherein the cone tapers out from the tube to the cylinder; wherein the cone increase an overall diameter of the snake to be compatible with the shaft.

9. The tool for dislodging a drainpipe according to claim 8 wherein the cylinder is located on the second end of the snake, which is opposite of the first end of the snake.

10. The tool for dislodging a drainpipe according to claim 9 wherein the cylinder houses the wedge receptacle, and provides a surface for the detach plunger to push against when detaching the snake; wherein the wedge receptacle is a cavity formed into the cylinder that is located on the second end of the snake.

11. The tool for dislodging a drainpipe according to claim 10 wherein the wedge receptacle corresponds with and receives the male wedge in order to secure the snake to the shaft.

12. The tool for dislodging a drainpipe according to claim 11 wherein the shaft comprises a handle, the pole, the detach plunger, and the male wedge; wherein the pole is a hollow tube, and is the structure to which the handle, detach plunger, and male wedge are attached; wherein the pole has a third end and a fourth end; wherein the male wedge is mounted at the fourth end of the pole.

13. The tool for dislodging a drainpipe according to claim 12 wherein the detach plunger is further defined with a rod and a plunge cap; wherein the rod has a fifth end and a sixth end; wherein the plunge cap is a disk that is mounted on the fifth end of the rod; wherein the plunge cap is manually pushed in order to detach the snake.

14. The tool for dislodging a drainpipe according to claim 13 wherein once the snake is attached to the shaft, the sixth end of the rod sits against the snake; wherein the rod is mounted inside the pole so that the snake is attached to the shaft and the sixth end of the rod sits against the snake.

15. The tool for dislodging a drainpipe according to claim 14 wherein the male wedge is attached to the fourth end of the pole; wherein the male wedge has a tapered shape; wherein the male wedge is attached to the pole.

* * * * *